US008632227B2

(12) United States Patent
Weaver

(10) Patent No.: US 8,632,227 B2
(45) **Date of Patent: *Jan. 21, 2014**

(54) HEAT REMOVAL SYSTEM AND METHOD FOR LIGHT EMITTING DIODE LIGHTING APPARATUS

(75) Inventor: Matthew Weaver, Scotts Valley, CA (US)

(73) Assignee: Lumenetix, Inc., Scotts Valley, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/284,773

(22) Filed: Oct. 28, 2011

(65) Prior Publication Data

US 2012/0099332 A1 Apr. 26, 2012

Related U.S. Application Data

(63) Continuation of application No. 12/892,696, filed on Sep. 28, 2010, now Pat. No. 8,047,690, which is a continuation of application No. 12/370,521, filed on Feb. 12, 2009, now Pat. No. 7,810,965.

(60) Provisional application No. 61/032,988, filed on Mar. 2, 2008.

(51) Int. Cl.
*F21V 29/00* (2006.01)

(52) U.S. Cl.
USPC ..... 362/373; 362/294; 362/264; 362/345

(58) Field of Classification Search
USPC ..... 362/373, 294, 264, 345
See application file for complete search history.

(56) References Cited

U.S. PATENT DOCUMENTS 3,316,497 A 4/1967 Brooks
3,390,341 A 6/1968 Kline (Continued)

FOREIGN PATENT DOCUMENTS

CN 1976643 A 6/2007
CN 101334155 A 12/2008

(Continued)

OTHER PUBLICATIONS

Behr, A.T. et al., "Nonlinearities of Capacitors Realized by MOSFET Gates", Proceedings of the International Symposium on Circuits and Systems, San Diego, May 10-13, 1992 [Proceedings of the International Symposium on Circuits and Systems, (ISCAS)], New York, IEEE, US, vol. 3, May 3, 1992, pp. 1284-1287, XP010061392 ISBN: 978-0-7803-0593-9.

(Continued)

*Primary Examiner* — Sharon Payne
(74) *Attorney, Agent, or Firm* — Perkins Coie LLP

(57) ABSTRACT

One heat removal assembly includes a plurality of fins configured to receive heat from a light emitting diode. In the plurality of fins, two adjacent fins are separated by a gap width, and each fin has a fin length. The heat removal assembly also includes a duct configured to draw a stack-effect airflow through the plurality of fins to remove heat from the plurality of fins. The gap width separating two adjacent fins and the fin length of each of the fins are configured to prevent boundary layer choking the plurality of fins. The heat removal assembly also includes a conductor and a thermal storage system configured to receive heat from the light emitting diode.

20 Claims, 6 Drawing Sheets

(56) References Cited

U.S. PATENT DOCUMENTS

| | | | | |
|---|---|---|---|---|
| 3,654,563 | A | 4/1972 | Hesler et al. | |
| 3,720,198 | A | 3/1973 | Laing et al. | |
| 4,237,023 | A | 12/1980 | Johnson | |
| 4,419,716 | A * | 12/1983 | Koo | 362/96 |
| 4,504,402 | A | 3/1985 | Chen et al. | |
| 4,581,285 | A | 4/1986 | Mahefkey, Jr. | |
| 4,617,332 | A | 10/1986 | Salyer et al. | |
| 4,749,951 | A | 6/1988 | Tanaka | |
| 4,797,160 | A | 1/1989 | Salyer | |
| 5,087,508 | A | 2/1992 | Beck | |
| 5,315,154 | A | 5/1994 | Elwell | |
| RE34,880 | E | 3/1995 | Salyer | |
| 5,722,482 | A | 3/1998 | Buckley | |
| 5,831,831 | A | 11/1998 | Freeland | |
| 5,890,794 | A | 4/1999 | Abtahi et al. | |
| 6,104,611 | A | 8/2000 | Glover et al. | |
| 6,227,285 | B1 | 5/2001 | Hildebrand et al. | |
| 6,307,871 | B1 | 10/2001 | Heberle | |
| 6,392,883 | B1 | 5/2002 | Ali | |
| 6,452,217 | B1 | 9/2002 | Wojnarowski et al. | |
| 6,482,332 | B1 | 11/2002 | Malach | |
| 6,652,771 | B2 | 11/2003 | Carn | |
| 6,793,856 | B2 | 9/2004 | Hartmann et al. | |
| 6,835,334 | B2 | 12/2004 | Davis et al. | |
| 7,002,800 | B2 | 2/2006 | Elias et al. | |
| 7,252,140 | B2 | 8/2007 | Glezer et al. | |
| 7,279,970 | B2 | 10/2007 | Yokoyama et al. | |
| 7,316,265 | B2 | 1/2008 | Searls et al. | |
| 7,329,033 | B2 | 2/2008 | Glovatsky et al. | |
| 7,345,320 | B2 | 3/2008 | Dahm | |
| 7,461,951 | B2 | 12/2008 | Chou et al. | |
| 7,575,354 | B2 | 8/2009 | Woodward | |
| 7,676,915 | B2 | 3/2010 | Ter-Hovhannissian | |
| 7,781,900 | B2 | 8/2010 | Carmona et al. | |
| 7,810,965 | B2 | 10/2010 | Weaver | |
| 7,828,465 | B2 | 11/2010 | Roberge et al. | |
| 7,886,809 | B2 | 2/2011 | Searls et al. | |
| 1,008,460 | A1 | 4/2011 | Lin at al. | |
| 7,959,327 | B2 | 6/2011 | Lai et al. | |
| 7,969,075 | B2 | 6/2011 | Weaver et al. | |
| 7,989,839 | B2 | 8/2011 | Dahm | |
| 8,021,023 | B2 | 9/2011 | Liu | |
| 8,031,393 | B2 | 10/2011 | Narendran et al. | |
| 8,047,690 | B2 | 11/2011 | Weaver | |
| 8,123,389 | B2 | 2/2012 | Hitchcock et al. | |
| 8,192,841 | B2 | 6/2012 | Amundson et al. | |
| 8,262,263 | B2 | 9/2012 | Dinh | |
| 8,427,036 | B2 | 4/2013 | Weaver et al. | |
| 2002/0033247 | A1 | 3/2002 | Neuschutz et al. | |
| 2002/0147242 | A1 | 10/2002 | Salyer et al. | |
| 2004/0057234 | A1 | 3/2004 | Mohacsi | |
| 2004/0113044 | A1 | 6/2004 | Ishiguchi | |
| 2004/0159422 | A1 | 8/2004 | Zuo et al. | |
| 2005/0030416 | A1 | 2/2005 | Kametani et al. | |
| 2005/0082043 | A1 | 4/2005 | Sarraf | |
| 2005/0158687 | A1 | 7/2005 | Dahm | |
| 2005/0196720 | A1 | 9/2005 | Ostler et al. | |
| 2005/0231983 | A1 | 10/2005 | Dahm | |
| 2005/0276053 | A1 | 12/2005 | Nortrup et al. | |
| 2006/0044059 | A1 | 3/2006 | Yokoyama et al. | |
| 2006/0044804 | A1 | 3/2006 | Ono et al. | |
| 2006/0086096 | A1 | 4/2006 | Ghoshal | |
| 2006/0151146 | A1 | 7/2006 | Chou et al. | |
| 2007/0114010 | A1 | 5/2007 | Upadhya et al. | |
| 2007/0125522 | A1 | 6/2007 | Stefanoski | |
| 2007/0189012 | A1 | 8/2007 | Huang et al. | |
| 2007/0230183 | A1 | 10/2007 | Shuy | |
| 2007/0253202 | A1 | 11/2007 | Wu et al. | |
| 2007/0268694 | A1 | 11/2007 | Bailey et al. | |
| 2007/0279862 | A1 | 12/2007 | Li | |
| 2007/0279921 | A1 | 12/2007 | Alexander et al. | |
| 2008/0094841 | A1 | 4/2008 | Dahm | |
| 2008/0094850 | A1 | 4/2008 | Woodward | |
| 2008/0285271 | A1 | 11/2008 | Roberge et al. | |
| 2009/0021944 | A1 | 1/2009 | Lee et al. | |
| 2009/0219726 | A1 | 9/2009 | Weaver et al. | |
| 2009/0219727 | A1 | 9/2009 | Weaver | |
| 2009/0273921 | A1 | 11/2009 | Chiang | |
| 2010/0017688 | A1 | 1/2010 | Mead et al. | |
| 2010/0201241 | A1 | 8/2010 | Weaver et al. | |
| 2010/0295468 | A1 | 11/2010 | Pedersen et al. | |
| 2011/0057552 | A1 | 3/2011 | Weaver | |
| 2011/0134645 | A1 | 6/2011 | Hitchcock et al. | |
| 2011/0303946 | A1 | 12/2011 | Weaver et al. | |

FOREIGN PATENT DOCUMENTS

| | | | |
|---|---|---|---|
| DE | 10 2005 054508 | A1 | 5/2007 |
| EP | 0612105 | A1 | 8/1994 |
| EP | 1717632 | A1 | 11/2006 |
| JP | 2002057262 | | 2/2002 |
| JP | 2004319658 | | 11/2004 |
| JP | 2007538045 | | 10/2005 |
| JP | 2007080463 | | 3/2007 |
| KR | 1020060125185 | | 6/2006 |
| KR | 1020100009218 | | 1/2010 |
| KR | 20100017600 | A | 2/2010 |
| WO | WO-02086795 | A1 | 10/2002 |
| WO | WO-2006047240 | A2 | 5/2006 |
| WO | WO-2009001254 | A2 | 12/2008 |
| WO | WO-2009010987 | A1 | 1/2009 |

OTHER PUBLICATIONS

Berkhout, M., "An Integrated 200-W Class-D Audio Amplifier", IEEE Journal of Solid-State Circuits, IEEE Service Center, Piscataway, NJ, US, vol. 38, No. 7, Jul. 1, 2003, pp. 1198-1206, XP001169604.

Co-pending U.S. Appl. No. 12/237,313, filed Sep. 24, 2008.

Co-pending U.S. Appl. No. 12/370,521, filed Feb. 12, 2009.

Co-pending U.S. Appl. No. 12/757,793, filed Apr. 9, 2010.

Co-pending U.S. Appl. No. 12/892,696, filed Sep. 28, 2010.

Co-pending U.S. Appl. No. 13/171,302, filed Jun. 28, 2011.

Co-pending U.S. Appl. No. 61/032,988, filed Mar. 2, 2008.

Co-pending U.S. Appl. No. 61/032,989, filed Mar. 2, 2008.

Co-pending U.S. Appl. No. 61/304,359, filed Feb. 12, 2010.

Final Office Action Mailed Jan. 25, 2011 in Co-pending U.S. Appl. No. 12/358,936, filed Feb. 10, 2009.

Gaalaas, E. et al., "Integrated Stereo Delta Sigma Class D Amplifier", IEEE Journal of Solid-State Circuits , IEEE Service Center, Piscataway, NJ, US [online] vol. 40, No. 12, Dec. 1, 2005, pp. 2388-2397, XP002504060, issn: 0018-9200, Retrieved from the Internet: URL:http://ieeexplore.ieee.org.[retrieved on Nov. 14, 2008, pp. 2388-2392].

International Search Report PCT/US2009/001253 dated May 27, 2009 pp. 1-3.

International Search Report PCT/US2009/001293 dated Oct. 9, 2009 pp. 1-4.

International Search Report PCT/US2009/069290, dated Jul. 14, 2010, pp. 1-3.

Non-Final Office Action Mailed Jul. 12, 2010 in Co-pending U.S. Appl. No. 12/370,521, filed Feb. 12, 2009.

Non-final Office Action Mailed Jun. 20, 2011 in Co-pending U.S. Appl. No. 12/757,793, filed Apr. 9, 2010.

Non-Final Office Action Mailed Mar. 16, 2011 in Co-pending U.S. Appl. No. 12/892,696, filed Sep. 28, 2010.

Non-Final Office Action Mailed Oct. 28, 2010 in Co-pending U.S. Appl. No. 12/368,936, filed Feb. 10, 2009.

Notice of Allowance Mailed Jul. 29, 2011 in Co-pending U.S. Appl. No. 12/892,696, filed Sep. 28, 2010.

Notice of Allowance Mailed Mar. 2, 2011 in Co-pending U.S. Appl. No. 12/358,936, filed Feb. 10, 2009.

Notice of Allowance Mailed Sep. 1, 2010 in Co-pending U.S. Appl. No. 12/370,521, filed Feb. 12, 2009.

Notice of Allowance Mailed Sep. 27, 2011 in Co-pending U.S. Appl. No. 12/757,793, filed Apr. 9, 2010.

Notice of Allowance Mailed Jan. 20, 2012 in Co-pending U.S. Appl. No. 12/757,793, filed Apr. 9, 2010.

(56) References Cited

OTHER PUBLICATIONS

Restriction Requirement Mailed Mar. 1, 2011 in Co-pending U.S. Appl. No. 12/237,313, filed Sep. 24, 2008.
Wang et al., "A Nonlinear Capacitance Cancellation Technique and and its Application to a CMOS Class AB Power Amplifier", 2001 IEEE Radio Frequency Integrated Circuits (RFIC) Symposium, Digest of Papers, Phoenix, AZ, May 20-22, 2001; [IEEE Radio Frequency Integrated Circuits Symposium], New York, NY, IEEE, US, May 20, 2001, pp. 39-42, XP010551317, ISBN: 978-0-7803-6601-5, pp. 40.
Written Opinion PCT/US2009/001253 dated May 27, 2009 pp. 1-3.
Written Opinion PCT/US2009/001293 dated Oct. 9, 2009 pp. 1-7.
Written Opinion PCT/US2009/069290 dated Jul. 14, 2010, pp. 1-3.
Supplementary European Search Report EP 09717472 dated Nov. 30, 2011 pp. 1-12.
International Search Report PCT/US2010/035653 Mailed Feb. 1, 2011, pp. 1-3.
Written Opinion PCT/US2010/035653 Mailed Feb. 1, 2011, pp. 1-6.
Final Office Action Mailed Jan. 25, 2011 in Co-pending U.S. Appl. No. 12/368,936, filed Feb. 10, 2009.
Notice of Allowance Mailed Mar. 2, 2011 in Co-pending U.S. Appl. No. 12/368,936, filed Feb. 10, 2009.
Co-pending U.S. Appl. No. 13/403,853, filed Feb. 23, 2012.
Non-Final Office Action mailed Sep. 7, 2012 in Co-pending U.S. Appl. No. 13/171,302, filed Jun. 28, 2011.
Notice of Allowance Mailed Mar. 11, 2013 in Co-pending U.S. Appl. No. 13/171,302, filed Jun. 28, 2009.
Office Action mailed Jun. 22, 2012, in Canadian Patent Application No. 2,716,832 filed Feb. 27, 2009, pp. 1-3.
Office Action mailed Apr. 5, 2012, in Chinese Patent Application No. 200980115871.5 filed Feb. 27, 2009, pp. 1-3, English translation included.
Office Action mailed Dec. 6, 2012, in Chinese Patent Application No. 200980115871.5 filed Feb. 27, 2009, pp. 1-3, English translation included.
Notification of Reasons of Refusal mailed Jul. 6, 2012, in Japanese Patent Application No. 2010-548744 filed Feb. 27, 2009, pp. 1-3, English translation included.
Office Action mailed Jul. 11, 2012, in Canadian Patent Application No. 2,716,829 filed Feb. 27, 2009, pp. 1-2.
Office Action mailed Jan. 29, 2013, in Chinese Patent Application No. 200980115236.7 filed Feb. 27, 2009, pp. 1-8, English translation included.
Notification of Reasons of Refusal mailed Mar. 8, 2013, in Japanese Patent Application No. 2010-549638 filed Feb. 27, 2009, pp. 1-4, English translation included.
Bera, S.C., et al., "Temperature Behavior and Compensation of Light-Emitting Diode", Nov. 2005, IEEE Photonics Technology Letters, vol. 17, No. 11, pp. 2286-2288.
Shibata, Masanobu, "Internal Resistance of an LED as a Function of Temperature", Jan. 2010, ISB Journal of Physics, http://www.isb.ac.th/HS/JoP/index.html, pp. 1-4.
Non-Final Office Action mailed Aug. 5, 2013, in Co-pending U.S. Appl. No. 12/237,313 by Weaver, M., et al., filed Sep. 24, 2008.

* cited by examiner

HEAT REMOVAL SYSTEM AND METHOD FOR LIGHT EMITTING DIODE LIGHTING APPARATUS

CLAIM OF PRIORITY

This application is a continuation of U.S. patent application Ser. No. 12/892,696, filed Sep. 28, 2010 and issuing as U.S. Pat. No. 8,047,690 on Nov. 1, 2011, which is a continuation of U.S. patent application Ser. No. 12/370,521, filed Feb. 12, 2009, issued on Oct. 12, 2010 as U.S. Pat. No. 7,810,965, all entitled "HEAT REMOVAL SYSTEM AND METHOD FOR LIGHT EMITTING DIODE APPARATUS", which claims priority to U.S. Provisional Patent Application No. 61/032,988 entitled "THERMAL CONVECTION MODEL FOR LED LAMPS," which was filed on Mar. 2, 2008, all of which are incorporated herein by reference in their entirety.

BACKGROUND

A light-emitting diode (LED) is a semiconductor diode that emits incoherent narrow-spectrum light when electrically biased in the forward direction of the p-n junction. LEDs have unique advantages over other lighting solutions. They operate at a high efficiency to produce more light output with lower input power, and have an inherently longer service life. For example, LEDs typically produce more light per watt than incandescent bulbs, and last much longer. Also, the output light of LEDs can be color matched and tuned to meet stringent lighting application requirements. In contrast, the output light of incandescent bulbs and fluorescent lights can not be as effectively tuned. Thus, LEDs which are often used in battery powered or energy saving devices are becoming increasingly popular in higher power applications such as, for example, flashlights, area lighting, and regular household light sources.

Unlike incandescent bulbs and fluorescent lights, LEDs are semiconductor devices that conventionally must operate at lower temperatures. This is so because, in part, the LED p-n junction temperature needs to be kept low enough to prevent degradation and failure. While incandescent bulbs and fluorescent lights lose heat by direct radiation from a very hot filament or gas discharge tube, respectively, LEDs must remove heat by conduction from the p-n junction to the case of the LED package before being dissipated. Conventional LED packages thus typically employ various heat removal schemes. The effectiveness of the heat removal scheme determines how well such LEDs perform, as cooler running temperatures yield higher efficacy for a given level of light output.

One conventional passive approach to cooling LEDs provides a finned heat sink exposed to external air. In such an approach, the thermal choke point in the heat transfer equation is typically the heat sink to air interface. To maximize heat transfer across this interface, the exposed heat sink surface area is typically maximized, and the heat sink fins are typically oriented to take advantage of any existing air flow over the fins. Unfortunately, such a conventional passive approach does not effectively cool LEDs for various reasons. Thus, in typical LED lighting applications that utilize this approach, the LEDs are often operated at less than half of their available light output capacity, to extend their lifetime and to preserve their efficiency.

Other LED lighting applications utilize a conventional active approach to cooling LEDs that forces air over a finned heat sink with, for example, a powered fan. Another example is a patent pending product, referred to as "SynJet," which uses a diaphragm displacement method to "puff" air over a finned heat sink. While such active approaches may be more effective in removing heat from LEDs, they have many negative issues. For example, these approaches typically utilized powered components which add cost to a given LED lighting application. In addition, these approaches typically are noisy, typically exhibit parasitic electrical loss, and typically introduce unreliable moving parts.

The foregoing examples of the related art and limitations related therewith are intended to be illustrative and not exclusive. Other limitations of the related art will become apparent upon a reading of the specification and a study of the drawings.

SUMMARY

A heat removal assembly for a light emitting diode lighting apparatus is described. One embodiment of the heat removal assembly includes a plurality of fins configured to receive heat from a light emitting diode. In the plurality of fins, two adjacent fins are separated by a gap width, and each fin has a fin length. The heat removal assembly also includes a duct configured to draw a stack-effect airflow through the plurality of fins to remove heat from the plurality of fins. The gap width separating two adjacent fins and the fin length of each of the fins are configured to prevent boundary layer choking the plurality of fins. In one embodiment, the heat removal assembly also includes a conductor and a thermal storage system configured to receive heat from the light emitting diode. A lighting apparatus including the heat removal assembly, a light emitting diode, and a connector plug is also described. In one embodiment, the lighting apparatus can be installed in a recessed can in which incoming and outgoing flows of a stack-effect airflow are separated. Methods for removing heat from a light emitting diode are also described.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

DETAILED DESCRIPTION

Described in detail below are heat removal systems and methods for a light emitting diode lighting apparatus.

Various aspects of the invention will now be described. The following description provides specific details for a thorough understanding and enabling description of these examples. One skilled in the art will understand, however, that the invention may be practiced without many of these details. Additionally, some well-known structures or functions may not be shown or described in detail, so as to avoid unnecessarily obscuring the relevant description. Although the diagrams depict components as functionally separate, such depiction is merely for illustrative purposes. It will be apparent to those skilled in the art that the components portrayed in this figure may be arbitrarily combined or divided into separate components.

The terminology used in the description presented below is intended to be interpreted in its broadest reasonable manner, even though it is being used in conjunction with a detailed description of certain specific examples of the invention. Certain terms may even be emphasized below; however, any terminology intended to be interpreted in any restricted manner will be overtly and specifically defined as such in this Detailed Description section.

Figure 1:
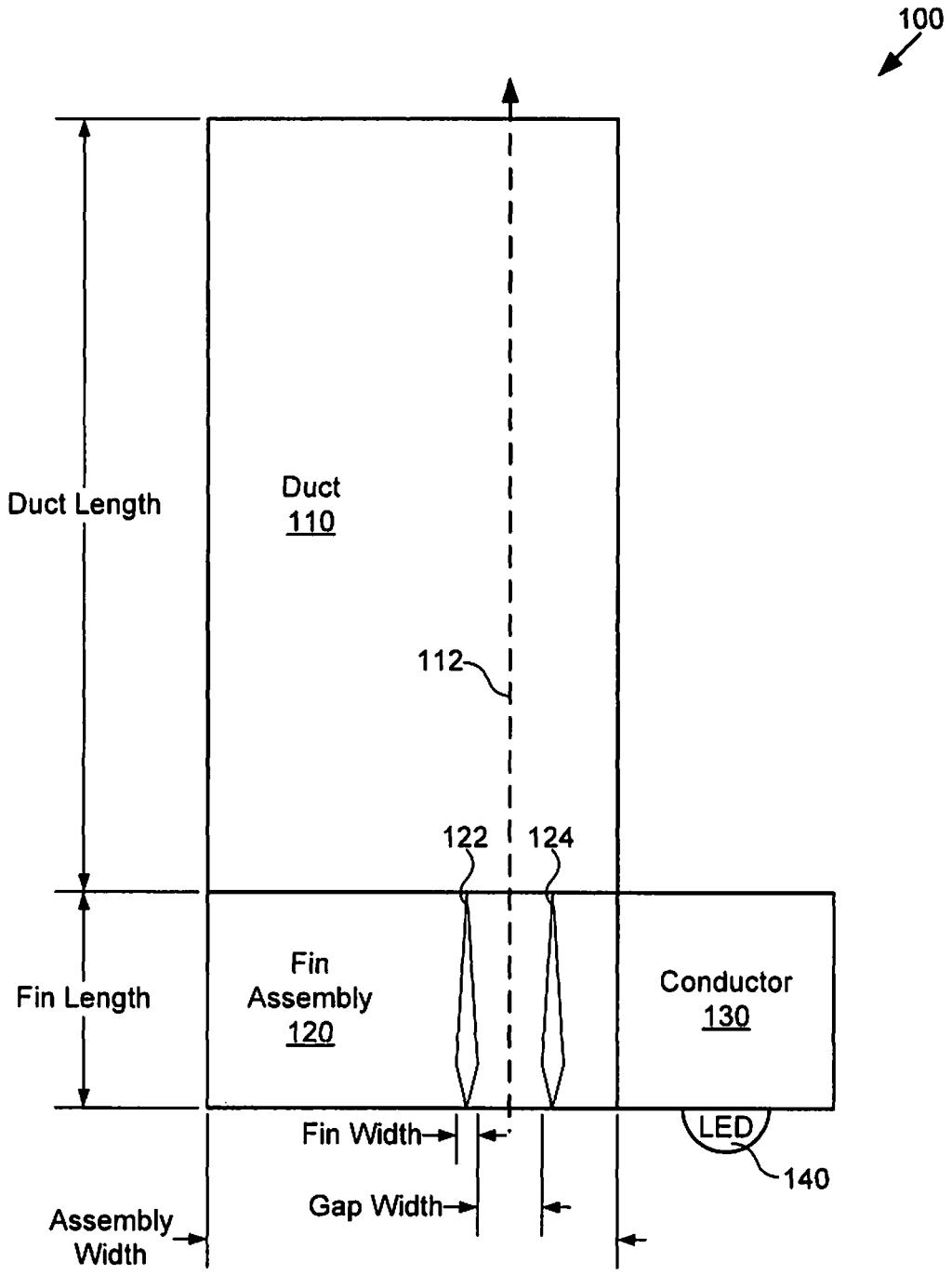
FIG. 1 depicts a block diagram of a lighting apparatus including a heat removal assembly according to an embodiment of the invention.

FIG. 1 depicts a block diagram of lighting apparatus 100 according to one embodiment of the invention. In the example of FIG. 1, lighting apparatus 100 includes duct 110, fin assembly 120, conductor 130, and light emitting diode ("LED") 140. Duct 110, fin assembly 120, and conductor 130 comprise a heat removal assembly of lighting apparatus 100. As discussed below, heat generated by LED 140 during operation is transferred by conduction through conductor 130 to fin assembly 120, and then transferred by convection to stack-effect airflow 112 flowing through fin assembly 120 and duct 110.

In various embodiments of the invention, LED 140 includes one LED or a plurality of LEDs. In embodiments wherein LED 140 includes a plurality of LEDs, the LEDs may be configured to emit light of a single color or of a uniform spectrum, or alternatively several of the LEDs may be configured to emit light of varying colors, or having different spectrums. In various embodiments wherein LED 140 includes a plurality of LEDs, the LEDs may be configured to emit light in one direction or in several directions. In further various embodiments wherein LED 140 includes a plurality of LEDs, the LEDs may be electrically coupled in series, in parallel, or in various combinations of both. Although in this discussion LED 140 is referred to as including at least one light emitting diode, various embodiments of the invention may include a light emitting device other than a light emitting diode. LED 140 may be configured to emit light through a lens or other optical structure.

In one embodiment of the invention, LED 140 is coupled to conductor 130 to transfer heat generated by LED 140 during operation (e.g., while LED 140 is receiving power and emitting light) to conductor 130 by conduction. To facilitate such conduction, LED 140 is coupled to conductor 130 utilizing, for example, thermal pads. A light emitting diode of LED 140 may transfer heat from an internal p-n junction to the thermal pads according to a manufacturer-specified thermal conductivity. In one embodiment of the invention, LED 140 is electrically coupled to a printed circuit board ("PCB") having an LED driver circuit for providing power to LED 140.

In one embodiment of the invention, conductor 130 has a mounting surface for LED 140 suited for efficient layout of a plurality of LEDs in LED 140. For example, conductor 130 has, in one embodiment, an H-shaped top suited for an efficient layout of a plurality of LEDs. In other embodiments conductor 130 may utilize a differently shaped mounting surface. In various embodiments, conductor 130 may be implemented with one type of material or multiple types of materials. For example, in one embodiment conductor 130 may be implemented as a copper conductor. In another embodiment, for example, conductor 130 may be implemented as a copper and aluminum conductor, wherein a copper subassembly of conductor 130 is soldered, screwed, or otherwise coupled to an aluminum subassembly. Although depicted with a square cross section in FIG. 1, conductor 130 may be implemented in a variety of shapes and sizes.

Fin assembly 120 is configured to receive heat generated by LED 140 during operation from conductor 130, and is further configured to transfer the heat by convection to stack-effect airflow 112 flowing through fin assembly 120 and duct 110. In various embodiments, in some cases like conductor 130, fin assembly 120 may be implemented with one type of material or multiple types of materials. For example, in one embodiment fin assembly 120 may be implemented as an aluminum fin assembly. Although fin assembly 120 is depicted in FIG. 1 disposed to the left of conductor 130, fin assembly 120 may be disposed spatially with respect to conductor 130 in a variety of ways according to the invention.

In one embodiment, conductor 130 and fin assembly 120 are substantially isothermal during operation of LED 140, because of a high thermal conductivity of conductor 130 and fin assembly 120 relative to a low thermal conductivity between fin assembly 120 and stack-effect airflow 112. Thus, in one embodiment conductor 130 and fin assembly 120 have a substantially uniform operational temperature. In another embodiment, a temperature gradient exists across conductor 130 and fin assembly 120, which together have an average operational temperature.

Exemplary fin 122 and exemplary fin 124 (collectively "fins 122 and 124") of fin assembly 120 are shown in FIG. 1. Fins 122 and 124 are illustrative, and in various embodiments of the invention fin assembly 120 has more than two fins. Further, although fins 122 and 124 are depicted as having diamond cross-sections in FIG. 1, various embodiments of the invention may implement a plurality of fins of fin assembly 120 as having, for example, rectangular cross sections, curved cross sections, aerodynamically-improved cross sections, or other cross sections. Further still, although fins 122 and 124 are depicted as discrete fins in FIG. 1, in other embodiments of the invention fin assembly 120 comprises an "overlapping" plurality of fins having a more-complex geometry. For example, in various embodiments, fin assembly 120 may comprise a plurality of fins having a grid or hexagonal cross section across a plane perpendicular to stack-effect airflow 112 (i.e., a grid or hexagonal cross section as viewed from below lighting apparatus 100 looking in the direction of stack-effect airflow 112).

As shown in FIG. 1, fins 122 and 124 each have a fin width and a fin length (or "chord length"), and fins 122 and 124 are separated by a gap width. Fins 122 and 124 each also have a fin depth not depicted in FIG. 1. In some embodiments, each fin in fin assembly 120 has a uniform fin length, fin width, and fin depth, while in other embodiments several fins may have varying fin lengths, fin widths, or fin depths. Also, in some embodiments each adjacent pair of fins in fin assembly 120 may have uniform gap widths, while in other embodiments various adjacent pairs of fins may have varying gap widths. Notably, in embodiments of the invention wherein fin assembly 120 comprises a plurality of fins having a grid or hexagonal cross section, the plurality of fins may still be characterized by a fin width, a fin length, a fin depth, and a gap width. Certain unique configurations of fin length, fin width, fin depth, and gap width enable the heat removal assembly of lighting apparatus 100 to achieve improved heat removal performance according to the invention, as discussed further below.

Duct 110 is configured as a passage for stack-effect airflow 112, which flows through both fin assembly 120 and duct 110, and which carries heat away from fin assembly 120 by convection. Duct 110, which has a duct length, is configured with respect to fin assembly 120 to exploit a "stack effect" (also called a "heatalator" or "chimney effect"). In particular, ambient air, preferably cooler than an operational temperature of fin assembly 120 described above, is heated by contact or proximity to fin assembly 120. The heated air then buoyantly rises through fin assembly 120, increasing in temperature as it remains in contact with or proximate to fin assembly 120, causing a contemporaneous decrease in air density. A stack effect provided by duct 110 results in a greater buoyant force and hence greater air flow through fin assembly 120. Stack-effect airflow 112 is the resulting flow through fin assembly 120 and duct 110. Notably, although stack-effect airflow 112 is depicted as a line between fins 122 and 124 and through duct 110, it is understood that stack-effect airflow 112 is, in one embodiment, a flow of air through substantially the volume unoccupied by the plurality of fins of fin assembly 120 and through substantially the volume of duct 110. Certain unique configurations of duct length of duct 112 enable the heat removal assembly of lighting apparatus 100 to achieve improved heat removal performance according to the invention.

The plurality of fins of fin assembly 120 impede stack-effect airflow 112 flowing through fin assembly 120 by, for example, reducing the inlet cross section of fin assembly 120. In an extreme case, wherein the sum of the fin widths of the plurality of fins equals the assembly width of fin assembly 120, stack-effect airflow 112 is completely blocked. This is true both for a greater quantity of fins having relatively lesser fin widths, and for a lesser quantity of fins having relatively greater fin widths. Thus, to avoid blocking or impeding stack-effect airflow 112, the number of fins and the fin width of each fin should be reduced. However, the amount of heat transferred from fin assembly 120 to stack-effect airflow 112 is substantially proportional to the total surface area of the plurality of fins of fin assembly 120. The total surface area of the plurality of fins is substantially dependent on, in one embodiment, the fin length and fin depth of each fin. Thus, to increase the amount of heat transferred from fin assembly 120 to stack-effect airflow 112, for a given fin length, fin depth, and fin width the number of fins should be increased.

According to the invention, a balance is struck by fin assembly 120 between the alternate rationales for decreasing and increasing the number of fins stated above. Informing the balance is the novel recognition that the number of fins of fin assembly 120 may be increased without unduly impeding stack-effect airflow 112, thereby improving the amount of heat transferred from fin assembly 120 to stack-effect airflow 112, until boundary layers of each fin begin interfering in the volume between each adjacent pair of fins. If the number of fins is increased further, and the gap width is thereby decreased below a critical distance, interference between the boundary layers of the fins "chokes" stack-effect airflow 112 along the fins, thereby detrimentally impeding stack-effect airflow 112. Notably, for a given assembly width and fin width, the number of fins required to choke stack-effect airflow 112 is less than the number of fins required to completely block stack-effect airflow 112, because the boundary layer width of each fin is wider than the fin width of each fin. Thus, the gap width separating two adjacent fins is configured to be greater than the boundary layer widths of the two adjacent fins.

In addition to the unique balance struck regarding the number of fins of fin assembly 120, a balance is struck, in various embodiments, in the ratio of the duct length of duct 110 to the fin length of fin assembly 120. Were duct 110 and fin assembly 120 configured in a conventional manner, the ratio might be very low, such that the fin length of fin assembly 120 is nonzero and the duct length is substantially zero. In effect, a conventional configuration might maximize the fin length and minimize the duct length, or forgo utilizing duct 110 at all. At first glance, such a configuration has the apparent advantage of increased total surface area of the plurality of fins, for a given fin depth of each fin, and also of increased mass. While increasing the mass of fin assembly 120 would marginally improve the performance of fin assembly 120 as a heat sink, such a configuration would ultimately be ineffective because the total thermal capacity of conductor 130 and fin assembly 120 would not be significantly improved by adding mass through fin length lengthening, and further because fin length lengthening ultimately reintroduces boundary layer interference issues along the plurality of fins. In contrast with such a conventional configuration, various embodiments of the invention utilize novel higher ratios of duct length to fin length. For example, in various embodiments the duct length may be equal to or slightly longer than the fin length. For another example, in various embodiments the duct length may be five to ten times the fin length. By so configuring such embodiments, boundary layer interference issues are avoided, and the flow of stack-effect airflow 112 through fin assembly 120 and duct 110 is greatly improved.

Figure 2:
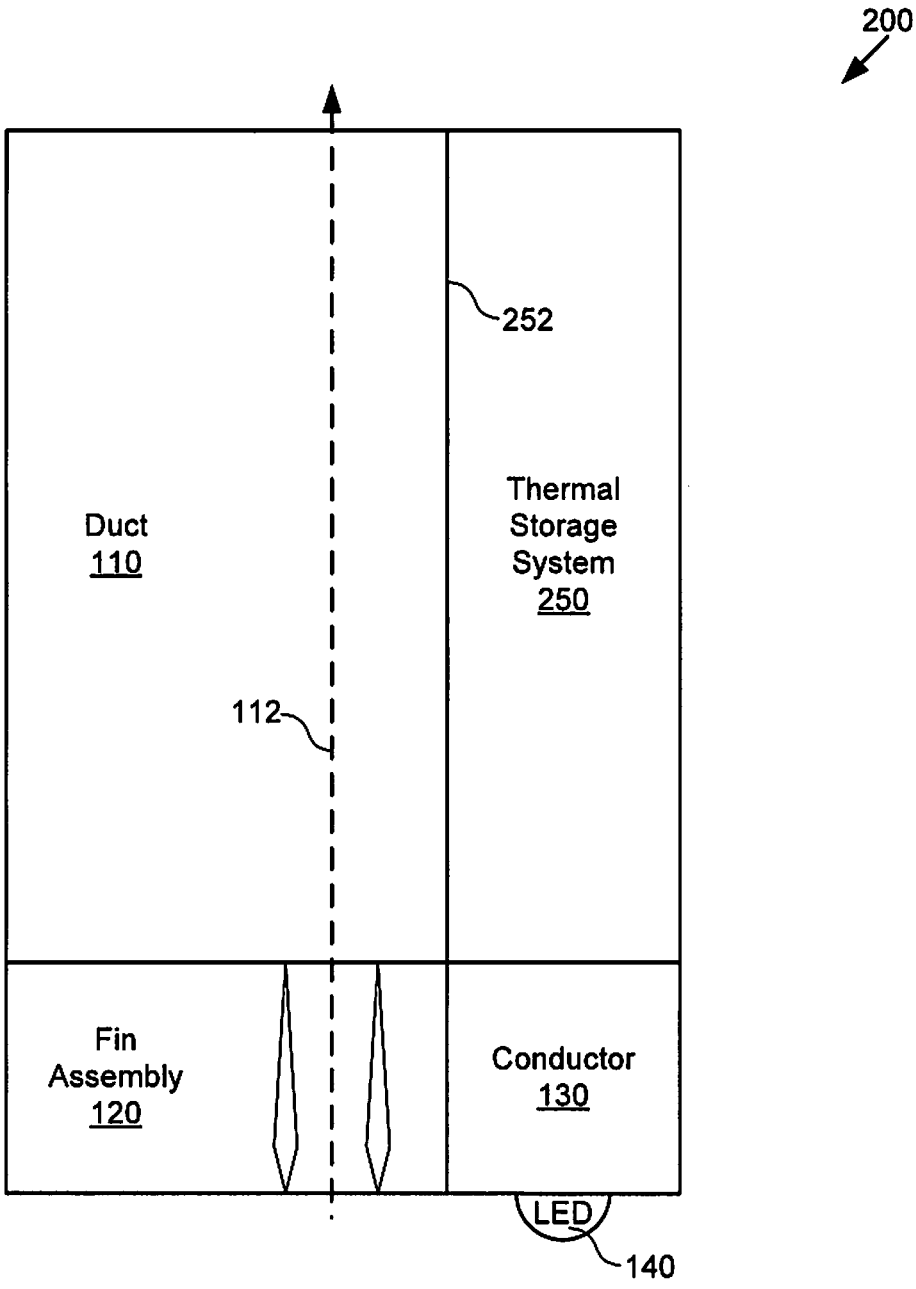
FIG. 2 depicts a block diagram of a lighting apparatus including a heat removal assembly according to an embodiment of the invention.

FIG. 2 depicts a block diagram of lighting apparatus 200 according to one embodiment of the invention. In the example of FIG. 2, lighting apparatus 200 includes duct 110, fin assembly 120, conductor 130, and light emitting diode ("LED") 140 of lighting apparatus 100. As discussed above regarding lighting apparatus 100, heat generated by LED 140 during operation is transferred by conduction through conductor 130 to fin assembly 120, and then transferred by convection to stack-effect airflow 112 flowing through fin assembly 120 and duct 110. Thus, duct 110, fin assembly 120, conductor 130, and light emitting diode ("LED") 140 of lighting apparatus 200 substantially correspond to those of lighting apparatus 100, except in variations noted below.

Lighting apparatus 200 additionally includes thermal storage system 250. Duct 110, fin assembly 120, conductor 130, and thermal storage system 250 comprise a heat removal assembly of lighting apparatus 200. Thermal storage system 250 corresponds, in one embodiment of the present invention, to a thermal storage system as described in U.S. patent application Ser. No. 12/237,313 entitled "THERMAL STORAGE SYSTEM USING PHASE CHANGE MATERIALS IN LED LAMPS," which was filed on Sep. 24, 2008, by Matthew Weaver et al, the contents of which are incorporated by reference herein. In one embodiment, a phase change material (PCM) included in thermal storage system 250 is used to absorb heat received via conduction from conductor 130 during operation of LED 140. The unique configuration of lighting apparatus 200, which has thermal storage system 250 and also has the heat removal assembly of lighting apparatus 100, enables the heat removal assembly of lighting apparatus 200 to achieve improved heat removal performance according to the invention.

In the example of FIG. 2, thermal storage system 250 is depicted with a rectangular cross section, but in various embodiments thermal storage system 250 may be implemented in a variety of shapes and sizes. FIG. 2 further depicts thermal storage system 250 coupled to duct 110 across surface 252. In some embodiments of the invention, surface 252 is a thermally insulating surface such that thermal storage system 250 and duct 110 do not thermally interact. In such embodiments, the heat characteristics of stack-effect airflow 112 and of thermal storage system 250 are substantially independent. In other embodiments, surface 252 is instead a thermally conducting surface, such as, for example, a surface implemented with material utilized in conductor 130. In such other embodiments, thermal storage system 250 and duct 110 may thermally interact, such that heat is transferred from stack-effect airflow 112 to thermal storage system 250, or vice versa. Notably, in some embodiments not depicted in FIG. 2, thermal storage system 250 and duct 110 are not coupled across surface 252 but are instead physically distinct and separated by, for example, air, a vacuum, or other portions of lighting apparatus 200.

In several embodiments, thermal storage system 250 and fin assembly 120 are both configured to receive heat from LED 140 via conductor 130. In such embodiments, the proportion of the heat generated by LED 140 that is conducted to thermal storage system 250 instead of to fin assembly 120 may vary, for example, with changes in the ambient air temperature, with the passage of time during operation as thermal storage system 250 stores heat energy, or with the passage of time after operation as thermal storage system 250 releases heat energy. In one embodiment, after operation of LED 140 has stopped, thermal storage system 250 releases heat into fin assembly 120 via conductor 130, thereby maintaining stack-effect airflow 112 after operation.

Figure 5:
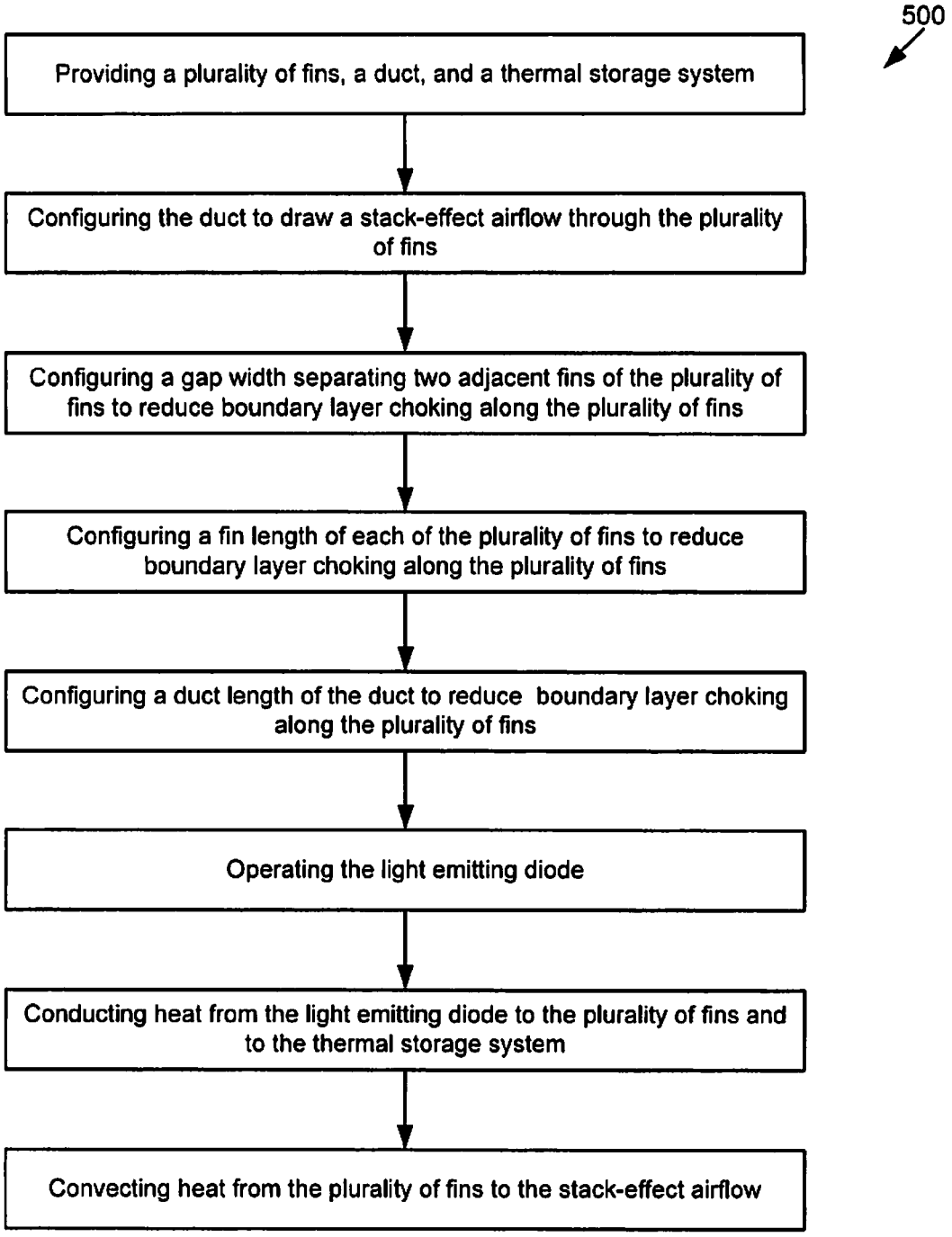
FIG. 5 depicts a flowchart for performing a method of removing heat from a light emitting diode according to an embodiment of the invention.

A method for removing heat from LED 140 can be described with respect to FIG. 2. The method comprises providing thermal storage system 250, providing a plurality of fins in fin assembly 120, and providing duct 110. The method further comprises configuring duct 110 to draw stack-effect airflow 112 through the plurality of fins, configuring a gap width separating two adjacent fins of the plurality of fins to reduce boundary layer choking along the plurality of fins, configuring a fin length of each of the plurality of fins to reduce boundary layer choking along the plurality of fins, and configuring a duct length of duct 110 to reduce boundary layer choking along the plurality of fins. The method also comprises operating LED 140, conducting heat from LED 140 to the plurality of fins, conducting heat from LED 140 to the thermal storage system, and convecting heat from the plurality of fins to stack-effect airflow 112. This method is depicted in flowchart 500 in FIG. 5.

Figure 3A:
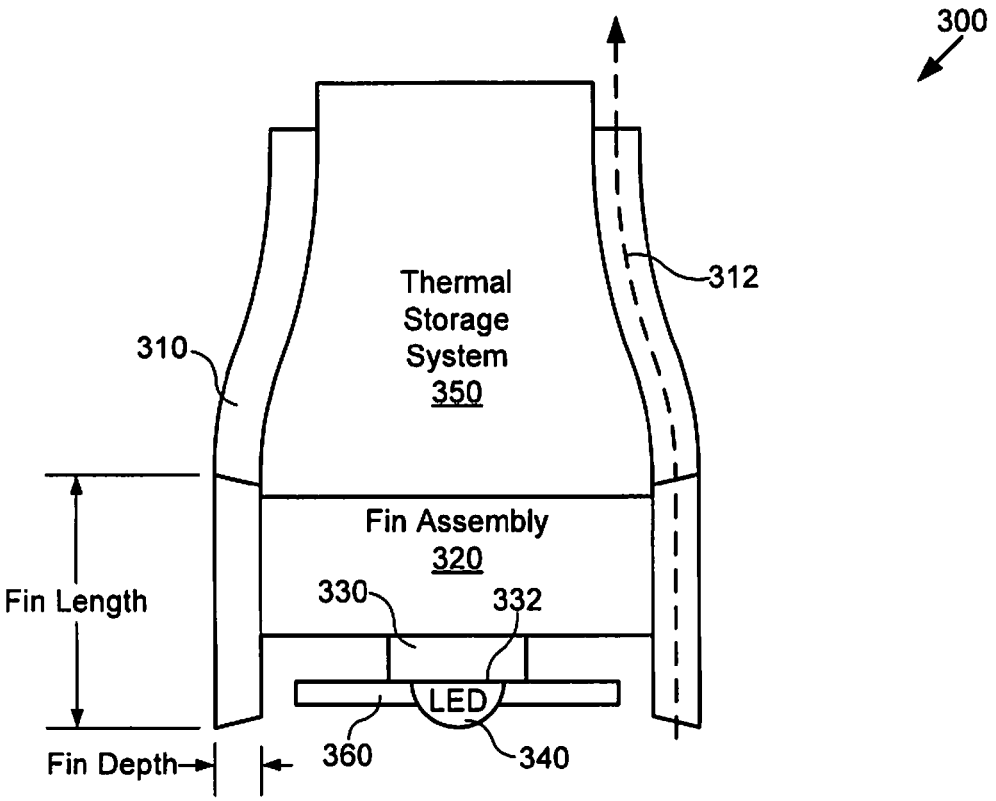
FIG. 3*a* depicts a block diagram of a lighting apparatus including a heat removal assembly according to an embodiment of the invention.
Figure 3B:
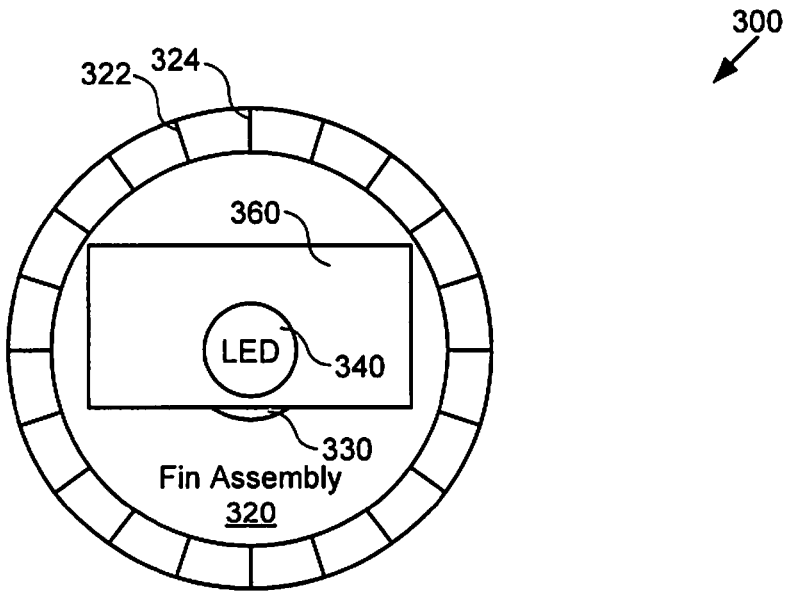
FIG. 3*b* depicts a block diagram of a lighting apparatus including a heat removal assembly according to an embodiment of the invention.

FIG. 3*a* and FIG. 3*b* (collectively "FIGS. 3*a* and 3*b*") depict a block diagram of lighting apparatus 300 according to one embodiment of the invention. FIG. 3*a* depicts a side view of lighting apparatus 300, and FIG. 3*b* depicts a bottom view of lighting apparatus 300. In the example of FIGS. 3*a* and 3*b*, lighting apparatus 300 includes duct 310, fin assembly 320, conductor 330, light emitting diode ("LED") 340, thermal storage system 350, and printed circuit board ("PCB") 360. Duct 310, fin assembly 320, conductor 330, and thermal storage system 350 comprise a heat removal assembly of lighting apparatus 300. In some embodiments of the invention, duct 310, fin assembly 320, conductor 330, LED 340, and thermal storage system 350 substantially correspond to duct 110, fin assembly 120, conductor 130, LED 140, and thermal storage system 250 of lighting apparatus 200, except in variations noted below. Thus, as discussed above regarding lighting apparatus 200, in some embodiments of the invention a portion of the heat generated by LED 340 during operation is transferred by conduction through conductor 330 to fin assembly 320, and then transferred by convection to stack-effect airflow 312 flowing through fin assembly 320 and duct 310, and another portion of the heat is transferred by conduction through conductor 330 and fin assembly 320 to thermal storage system 350. In one embodiment of the invention, lighting apparatus 300 may omit thermal storage system 350.

As depicted in FIGS. 3*a* and 3*b*, fin assembly 320 and duct 310 at least partially enclose a volume that is substantially occupied by other subassemblies of lighting apparatus 300. Although depicted in FIG. 3*b* as having circular cross sections, fin assembly 320 and duct 310 may have various other cross sectional shapes in other embodiments of the invention. For example, in other embodiments, fin assembly 320 and duct 310 may have ellipsoidal, triangular, rectangular, or yet other cross sectional shapes. Thermal storage system 350 and conductor 330 may have, in various embodiments, similarly varying cross sections. In one embodiment not depicted in FIGS. 3*a* and 3*b*, fin assembly 320 and duct 310 are configured to pass through an interior volume of either or both of thermal storage system 350 and conductor 330. In another embodiment not depicted in FIGS. 3*a* and 3*b*, conductor 330 is configured to pass through an interior volume of fin assembly 320 to contact thermal storage system 350.

As depicted in FIGS. 3*a* and 3*b*, in one embodiment LED 340 is coupled to mounting surface 332 of conductor 330. To transfer heat generated by LED 340 during operation to conductor 330, LED 340 is coupled to mounting surface 332 utilizing, for example, thermal pads. In one embodiment of the invention, mounting surface 332 is suited for efficient layout of a plurality of LEDs in LED 340. Mounting surface 332 may be configured with, for example, a circular or semi-circular top suited for an efficient layout of a plurality of LEDs. In other embodiments, mounting surface 332 may utilize a differently shaped top, such as, for example, an H-shaped top or a rectangular top. In such embodiments, for example, mounting surface 332 may comprise multiple surfaces at different heights for mounting LED 340 and PCB 360 at different heights.

As shown in FIGS. 3*a* and 3*b*, conductor 330 may be mounted at a center of fin assembly 320. In various embodiments, conductor 330 may be implemented with one type of material or multiple types of materials. For example, in one embodiment conductor 330 may be implemented as a copper conductor. In another embodiment, a portion of conductor 330 may be implemented as an aluminum conductor. Conductor 330 may be, for example, soldered, screwed, or otherwise coupled to fin assembly 320. Conductor 330 may be implemented in a variety of shapes and sizes.

In one embodiment of the invention, LED 340 is electrically coupled to PCB 360. As shown in FIGS. 3*a* and 3*b*, PCB 360 may be configured to fit within a circumference of fin assembly 320. As further shown in FIGS. 3*a* and 3*b*, PCB 360 may be configured to be coupled to mounting surface 332 of conductor 330 adjacent to LED 340. By so configuring PCB 360, lighting apparatus 300 advantageously achieves, for example, a compact form that efficiently utilizes space. Although PCB 360 is depicted as having a rectangular cross section in FIG. 3*b*, in another embodiment PCB 360 may have, for example, a circular cross section or another cross section. PCB 360 includes, in one embodiment, an LED driver circuit for providing power to LED 140. The LED driver circuit corresponds, in one embodiment, to a driver circuit as described in U.S. patent application Ser. No. 13/162,501 entitled "ELECTRICAL CIRCUIT FOR DRIVING LEDS IN DISSIMILAR COLOR STRING LENGTHS," by Matthew Weaver, which is filed herewith, the contents of which are incorporated by reference herein.

Fin assembly 320 is configured to receive heat generated by LED 340 during operation from conductor 330, and is further configured to transfer the heat by convection to stack-effect airflow 312 flowing through fin assembly 320 and duct 310. In various embodiments, fin assembly 320 may be implemented with one type of material or multiple types of materials. In one embodiment, conductor 330 and fin assembly 320 are substantially isothermal.

Exemplary fin 322, exemplary fin 324, and additional fins are shown in FIG. 3*b* arranged around a circumference of fin assembly 320. The plurality of fins including exemplary fin 322 and exemplary fin 324 is illustrative, and in various embodiments each of the plurality of fins has, for example, rectangular cross sections, curved cross sections, aerodynamically-improved cross sections, or other cross sections. Although the plurality of fins are depicted as discrete fins in FIG. 3*b*, in other embodiments fin assembly 320 comprises an "overlapping" plurality of fins having a more complex geometry, such as a grid geometry or a hexagonal geometry.

Each of the plurality of fins of fin assembly 320 has a fin depth shown in FIG. 3*b* (e.g. the distance from an outer circumference of fin assembly 320 to an inner circumference of fin assembly 320). As also shown in FIG. 3*b*, each of the plurality of fins has a fin width, and is separated from adjacent fins by a gap width (e.g. a portion of a circumference of fin assembly 320). In one embodiment an entire circumference of fin assembly 320 comprises the assembly width. As shown in FIG. 3*a*, each of the plurality of fins has a fin length (or "chord length") and a fin depth. Certain configurations of fin length, fin width, fin depth, and gap width enable a heat removal assembly of lighting apparatus 300 to achieve improved heat removal performance according to the invention, in a manner corresponding to that discussed above with respect to lighting apparatus 100.

Notably, although FIGS. 3*a* and 3*b* depict the fin depth of the plurality of fins as extending from an outer circumference to an inner circumference of fin assembly 320, other embodiments may have a different configuration. For example, in various embodiments a fin may be attached to the outer circumference and extend only partially inward toward the inner circumference, and in various other embodiments, a fin may be attached to the inner circumference and extend only partially outward toward the outer circumference. A third variety of embodiments includes two groups of such partially-extending fins respectively attached to either the inner or outer circumference.

Duct 310 is configured as a passage for stack-effect airflow 312, which flows through both fin assembly 320 and duct 310, and which carries heat away from fin assembly 320 by convection. In one embodiment, an outer surface of duct 310 is implemented with a thermally insulating material (e.g., plastic) to prevent thermal interaction between stack-effect airflow 312 and the ambient environment. Duct 310 is configured with respect to fin assembly 320 to exploit a stack effect in a manner corresponding to that discussed above with respect to duct 110. Although stack-effect airflow 312 is depicted as a line in FIG. 3*a*, it is understood that stack-effect airflow 312 is, in one embodiment, a flow of air through substantially the volume unoccupied by the plurality of fins of fin assembly 320 and through substantially the volume between outer and inner circumferences of fin assembly 320 and duct 310. Certain configurations of a duct length of duct 310 enable a heat removal assembly of lighting apparatus 300 to achieve improved heat removal performance according to the invention, in a manner corresponding to that discussed above with respect to lighting apparatus 100.

As depicted in FIG. 3*a*, the cross-sectional area of duct 310 through which stack-effect airflow 312 flows decreases with duct length, because the width of duct 310 between inner and outer circumferences remains substantially constant while the diameter of duct 310 decreases. Accordingly, the velocity of stack-effect airflow 312 in the narrowing passage increases while the local static pressure of stack-effect airflow 312 drops. This creates, in one embodiment, a favorable pressure gradient which keeps the boundary layers thin and prevents them from separating from a surface of duct 310. The performance of stack-effect airflow 312 is thereby enhanced.

Figure 3C:
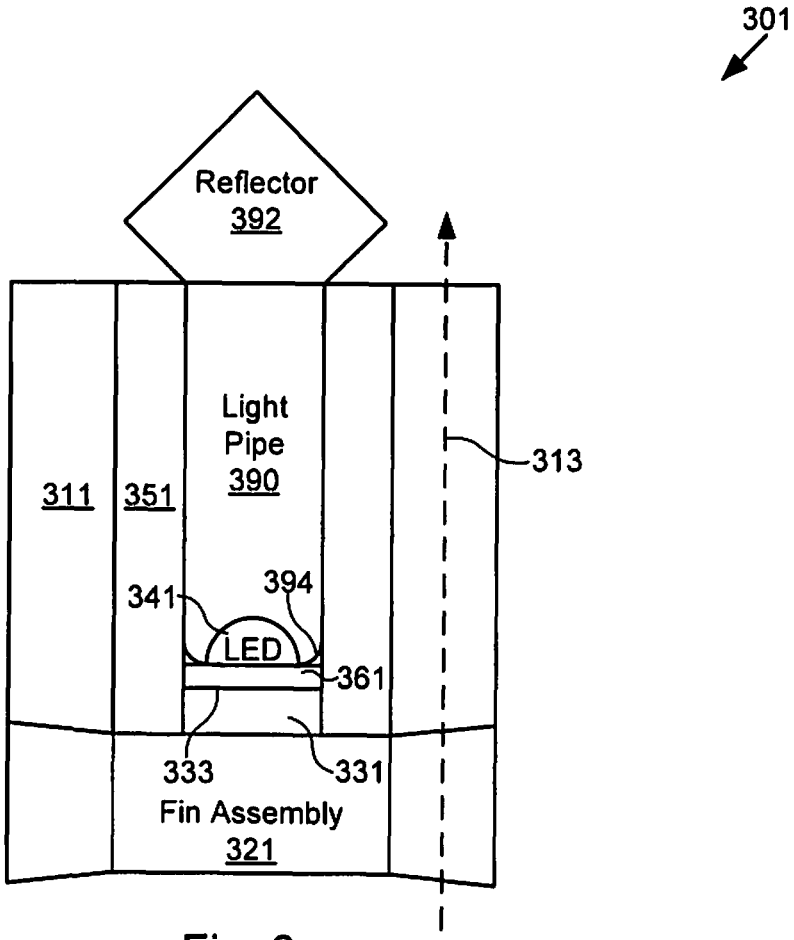
FIG. 3*c* depicts a block diagram of a lighting apparatus including a heat removal assembly according to an embodiment of the invention.

FIG. 3*c* depicts a block diagram of lighting apparatus 301 according to one embodiment of the invention. FIG. 3*c* depicts a side view of lighting apparatus 301. In the example of FIG. 3*c*, lighting apparatus 301 includes duct 311, fin assembly 321, conductor 331, light emitting diode ("LED") 341, thermal storage system 351, printed circuit board ("PCB") 361, light pipe 390, top reflector 392, and bottom reflector 394. Duct 311, fin assembly 321, conductor 331, and thermal storage system 351 comprise a heat removal assembly of lighting apparatus 301. In some embodiments of the invention, duct 311, fin assembly 321, conductor 331, LED 341, and thermal storage system 351 substantially correspond to duct 310, fin assembly 320, conductor 330, LED 340, and thermal storage system 350 of lighting apparatus 300, except in variations noted below. Thus, as discussed above regarding lighting apparatus 300, in some embodiments of the invention a portion of the heat generated by LED 341 during operation is transferred by conduction through conductor 331 to fin assembly 321, and then transferred by convection to stack-effect airflow 313 flowing through fin assembly 321 and duct 311, and another portion of the heat is transferred by conduction through conductor 331 and fin assembly 321 to thermal storage system 351. In one embodiment of the invention, lighting apparatus 301 may omit thermal storage system 351.

As shown in FIG. 3*c*, LED 341 is disposed within lighting apparatus 301 and is configured to shine up through light pipe 390. In contrast, as shown in FIG. 3*a*, LED 340 is disposed on a periphery of lighting apparatus 300 and is configured in one embodiment to shine down from lighting apparatus 300. Notably, in both lighting apparatus 300 and lighting apparatus 301, stack-effect airflow 312 and stack-effect airflow 313, respectively, are configured to flow upward. Thus, lighting apparatus 300 is well suited, for example, for ceiling installations or other installations where light is to be directed substantially downward, and lighting apparatus 301 is well suited, for example, for floor installations or other installations where light is to be directed substantially upward.

Lighting apparatus 301 includes light pipe 390, top reflector 392, and bottom reflector 394. Light pipe 390 is configured in various embodiments as, for example, a hollow guide, a guide with an inner reflective surface, a transparent plastic or glass guide, a fiber-optic guide, or another type of light guide. Top reflector 392 is implemented as, for example, a translucent, decorative reflector configured to appear as a candle flame. In another embodiment, top reflector 392 is implemented as a lens or reflector for redirecting light from light pipe 390 in a decorative manner or in a utilitarian manner. Although depicted as having a partial diamond or square cross section in FIG. 3*c*, top reflector 392 is implemented, in other embodiments, with circular, rectangular, or other cross sections, for example. Bottom reflector 394 is implemented with, for example, a mirrored surface which may be parabolic or may have another shape designed to maximize the amount of light going into light pipe 390. Bottom reflector 394 may be positioned adjacent to LED 341, around LED 341, or behind LED 341 with respect to light pipe 390. Light pipe 390 is configured to directly gather some or all of the light emitted by LED 341, and to guide the gathered light to top reflector 392. In one embodiment, some or all of the light that is not directly gathered by light pipe 390 is reflected from bottom reflector 394 and redirected to light pipe 390. Light pipe 390 may thus indirectly gather some of the light emitted by LED 341 via bottom reflector 394. In some embodiments, top reflector 392 is omitted from lighting apparatus 301, such that light is emitted directly from light pipe 390.

As depicted in FIG. 3*c*, fin assembly 321 and duct 311 at least partially enclose a volume that is substantially occupied by other subassemblies of lighting apparatus 301. Fin assembly 321 and duct 311 may have a circular cross sectional shape similar to fin assembly 320 and duct 310 of lighting apparatus 300, or may have various other cross sectional shapes such as, for example, ellipsoidal, triangular, rectangular, or yet other cross sectional shapes. Thermal storage system 351, conductor 331, and light pipe 390 may have, in various embodiments, similarly varying cross sections. In one embodiment not depicted in FIG. 3*c*, fin assembly 321 and duct 311 are configured to pass through an interior volume of either or both of thermal storage system 351 and conductor 331. In another embodiment not depicted in FIG. 3*c*, light pipe 390 is not surrounded by thermal storage system 351, but is instead adjacent to thermal storage system 351 within a volume at least partially enclosed by fin assembly 321 and duct 311. In another embodiment not depicted in FIG. 3*c*, light pipe 390 surrounds either or both of thermal storage system 351 and duct 311.

In one embodiment, LED 341 is coupled to mounting surface 333 of conductor 331 in a manner similar to how LED 340 is coupled to mounting surface 332 of conductor 330 of lighting apparatus 300. In another embodiment, LED 341 is coupled to PCB 361 which is coupled to mounting surface 333 of conductor 331. In such an embodiment, PCB 361 may have a portion configured with low heat resistance for heat transfer from LED 341 to conductor 331. Conductor 331 may be mounted at a center of fin assembly 321. In various embodiments, conductor 331 may be implemented with materials similar to those utilized for conductor 330 of lighting apparatus 300. Conductor 331 may be implemented in a variety of shapes and sizes. In one embodiment of the invention, LED 341 is electrically coupled to PCB 361, which is configured in a manner similar to PCB 360 of lighting apparatus 300. PCB 361 may be configured to fit within a circumference of thermal storage system 351. By so configuring PCB 361, lighting apparatus 301 advantageously achieves, for example, a compact form that efficiently utilizes space.

Fin assembly 321 is configured to receive heat generated by LED 341 during operation from conductor 331, and is further configured to transfer the heat by convection to stack-effect airflow 313 flowing through fin assembly 321 and duct 311. Fin assembly 321 may be implemented in a manner similar to fin assembly 320 of lighting apparatus 300. Therefore, fin assembly 321 comprises, for example, a plurality of fins arranged around a circumference of fin assembly 321. The plurality of fins may have, for example, rectangular cross sections, curved cross sections, aerodynamically-improved cross sections, or other cross sections, and may in some embodiments comprise an "overlapping" plurality of fins having a grid geometry or a hexagonal geometry, for example. Certain configurations of fin assembly 321 enable a heat removal assembly of lighting apparatus 301 to achieve improved heat removal performance according to the invention, in a manner corresponding to that discussed above with respect to lighting apparatus 300.

Duct 311 is configured as a passage for stack-effect airflow 313, which flows through both fin assembly 321 and duct 311, and which carries heat away from fin assembly 321 by convection. Duct 311 is configured with respect to fin assembly 321 to exploit a stack effect in a manner corresponding to that discussed above with respect to duct 310. Although stack-effect airflow 313 is depicted as a line in FIG. 3*c*, it is understood that stack-effect airflow 313 is, in one embodiment, a flow of air through substantially the volume unoccupied by the plurality of fins of fin assembly 321 and through substantially the volume between outer and inner circumferences of fin assembly 321 and duct 311. Certain configurations of a duct length of duct 311 enable a heat removal assembly of lighting apparatus 301 to achieve improved heat removal performance according to the invention, in a manner corresponding to that discussed above with respect to lighting apparatus 300. Although FIG. 3*c* depicts the cross-sectional area of duct 311 through which stack-effect airflow 313 flows as remaining substantially constant with duct length, in another embodiment the cross-sectional area of duct 311 decreases with duct length in a manner similar to duct 310 of lighting apparatus 300.

Figure 4:
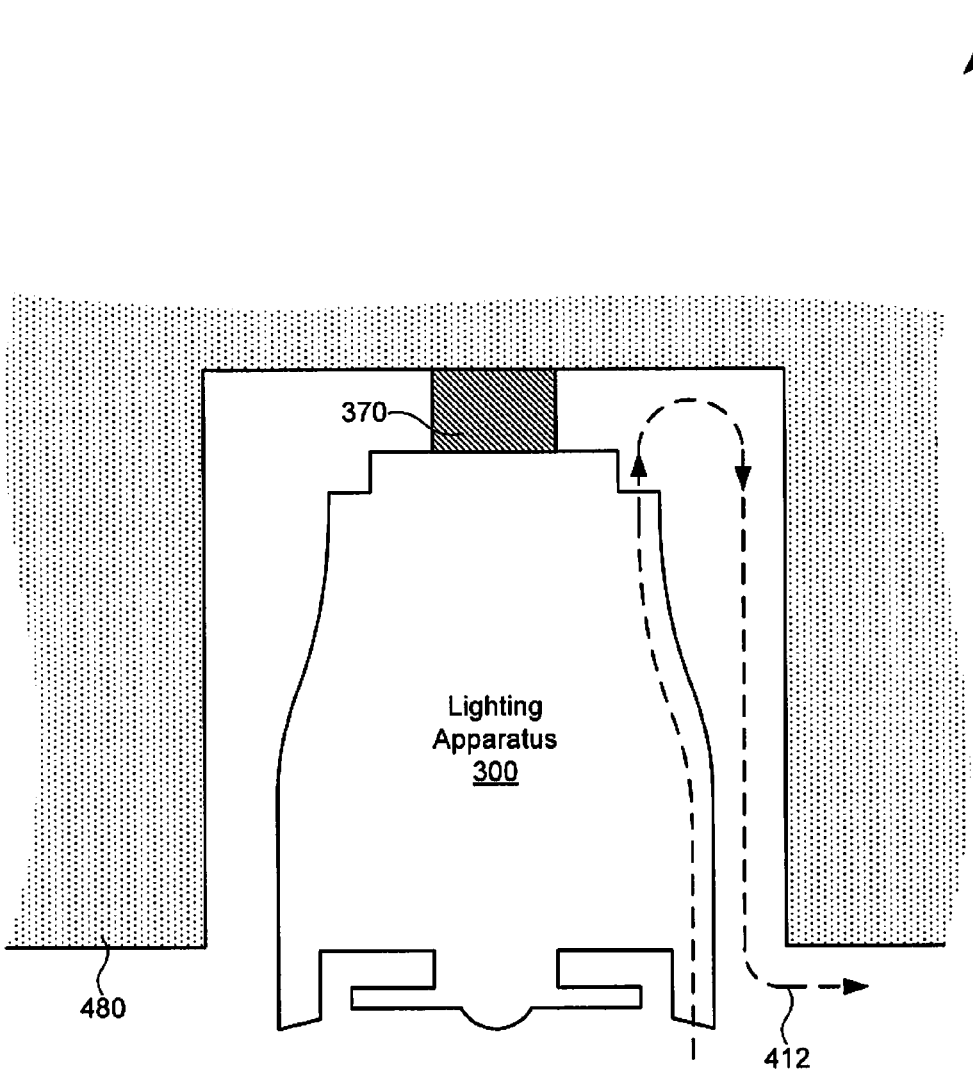
FIG. 4 depicts an installation including a lighting apparatus according to an embodiment of the invention.

FIG. 4 depicts installation 400, which includes lighting apparatus 300 installed in a recessed can in ceiling 480. In the example of FIG. 4, details of lighting apparatus 300 such as duct 310, fin assembly 320, conductor 330, LED 340, thermal storage system 350, and PCB 360 are not depicted. Connector 370, not shown in FIGS. 3*a* and 3*b*, comprises a connector plug coupled to (e.g., screwed into) a power socket for providing power to lighting apparatus 300. In one embodiment, connector 370 is coupled to PCB 360 via electrical wires disposed within or around lighting apparatus 300. Connector 370 may additionally comprise, in one embodiment, a power supply configured to transform a voltage or current of the power socket into a voltage or current suitable for an LED driver circuit of PCB 360. In other embodiments of the invention, instead of being installed in a recessed can in ceiling 480, lighting apparatus 300 may be installed in, for example, a track-lighting fixture, a hanging fixture, a candelabra base, or another type of fixture. Although in FIG. 4 a portion of lighting apparatus 300 is depicted extending below a lowest surface of ceiling 480, in other embodiments lighting apparatus 300 may be level with a lowest surface of ceiling 480, or may be entirely above a lowest surface of ceiling 480 (e.g., completely enclosed within a recessed can of ceiling 480).

In the example of FIG. 4, stack-effect airflow 412 is shown. In some embodiments of the invention, a portion of the heat generated by LED 340 of lighting apparatus 300 during operation is transferred by conduction to fin assembly 320, and then transferred by convection to stack-effect airflow 412, in a manner similar to stack-effect airflow 312. Notably, in FIG. 4, stack-effect airflow 412 is shown rising inside lighting apparatus 300, and descending outside lighting apparatus 300 while inside the recessed can of ceiling 480. Thus, in the example of FIG. 4, duct 310 inside lighting apparatus 300 also serves the unique function of separating an incoming flow and an outgoing flow of stack-effect airflow 412. An outer surface of duct 310 may be implemented with a thermally insulating material (e.g., plastic) to prevent thermal interaction between the incoming flow and the outgoing flow of stack-effect airflow 412.

Duct 310 thus provides a clear and unobstructed path for air to rise, to be exhausted from lighting apparatus 300, to meet the upper surface of the recessed can and flow radially outward, and then to flow back down along the periphery of the recessed can and finally to exit out of the recessed can, where stack-effect airflow 412 then flows radially outward along ceiling 480, away from lighting apparatus 300. The unique configuration of installation 400, including lighting apparatus 300, thus achieves improved heat removal performance according to the invention.

The words "herein," "above," "below," and words of similar import, when used in this application, shall refer to this application as a whole and not to any particular portions of this application. Where the context permits, words in the above Detailed Description using the singular or plural number may also include the plural or singular number respectively. The word "or," in reference to a list of two or more items, covers all of the following interpretations of the word: any of the items in the list, all of the items in the list, and any combination of the items in the list.

The foregoing description of various embodiments of the claimed subject matter has been provided for the purposes of illustration and description. It is not intended to be exhaustive or to limit the claimed subject matter to the precise forms disclosed. Many modifications and variations will be apparent to the practitioner skilled in the art. Embodiments were chosen and described in order to best describe the principles of the invention and its practical application, thereby enabling others skilled in the relevant art to understand the claimed subject matter, the various embodiments and with various modifications that are suited to the particular use contemplated.

The teachings of the invention provided herein can be applied to other systems, not necessarily the system described above. The elements and acts of the various embodiments described above can be combined to provide further embodiments.

While the above description describes certain embodiments of the invention, and describes the best mode contemplated, no matter how detailed the above appears in text, the invention can be practiced in many ways. Details of the system may vary considerably in its implementation details, while still being encompassed by the invention disclosed herein. As noted above, particular terminology used when describing certain features or aspects of the invention should not be taken to imply that the terminology is being redefined herein to be restricted to any specific characteristics, features, or aspects of the invention with which that terminology is associated. In general, the terms used in the following claims should not be construed to limit the invention to the specific embodiments disclosed in the specification, unless the above Detailed Description section explicitly defines such terms. Accordingly, the actual scope of the invention encompasses not only the disclosed embodiments, but also all equivalent ways of practicing or implementing the invention under the claims.

What is claimed is:

1. A heat removal assembly for a lighting apparatus, the heat removal assembly comprising:

an interconnected plurality of fins configured to receive heat from a light source of the lighting apparatus, wherein the interconnected plurality of fins has a fin length, and the interconnected plurality of fins is configured to have gap spaces in a cross-section in a direction substantially perpendicular to the fin length; and a duct configured to draw a stack-effect airflow substantially along the fin length through the gap spaces to remove heat from the interconnected plurality of fins, wherein the gap spaces are configured to reduce interference between neighboring boundary layers that form along each of the fins for a particular duct and fin configuration for the lighting apparatus, and wherein the interconnected plurality of fins and the duct are further configured such that the stack-effect airflow in the duct is blocked if dimensions of the interconnected plurality of fins in a plane of the cross-section are increased to eliminate the gap spaces.

2. The heat removal assembly of claim 1, wherein the fin length of the interconnected plurality of fins and a duct length of the duct are selected to reduce interference between neighboring boundary layers that form along the interconnected plurality of fins within the duct for a particular duct and fin configuration for the lighting apparatus.

3. The heat removal assembly of claim 1, wherein the fin length of the interconnected plurality of fins is configured to be shorter than a duct length of the duct.

4. The heat removal assembly of claim 1, wherein the duct is further configured with a cross-sectional area that decreases in the direction of the stack-effect airflow.

5. The heat removal assembly of claim 1, further comprising a conductor configured to conduct heat from the light source to the plurality of fins.

6. The heat removal assembly of claim 5, wherein the conductor and the plurality of fins have a substantially uniform temperature.

7. The heat removal assembly of claim 5, wherein a temperature gradient is present across the conductor and the plurality of fins.

8. The heat removal assembly of claim 5, wherein the light source is configured to be substantially situated at a center of the conductor, further wherein the interconnected plurality of fins are configured to be substantially situated at an edge of the conductor, and further wherein the conductor is further configured to conduct heat outward from the center to the edge.

9. The heat removal assembly of claim 1, further comprising a thermal storage system configured to receive heat from the light source.

10. The heat removal assembly of claim 9, wherein the thermal storage system includes a phase change material.

11. The heat removal assembly of claim 9, wherein the thermal storage system is configured to be disposed within a volume substantially surrounded by the duct.

12. A method of removing heat from a light emitting diode, the method comprising:

conducting heat away from the light emitting diode to an interconnected plurality of fins, wherein the interconnected plurality of fins extends along a fin length, and the interconnected plurality of fins is configured to have gap spaces in a cross-section in a direction substantially perpendicular to the fin length; and convecting heat from the interconnected plurality of fins to a stack-effect airflow, wherein a duct draws the stack-effect airflow substantially along the fin length through the gap spaces, and further wherein the gap spaces are configured to reduce interference between neighboring boundary layers that form along each of the fins of the interconnected plurality of fins, and wherein the interconnected plurality of fins and the duct are further configured such that the stack-effect airflow in the duct is blocked if dimensions of the interconnected plurality of fins in a plane of the cross-section are increased to eliminate the gap spaces.

13. The method of claim 12, further comprising:

configuring the fin length of the interconnected plurality of fins and a duct length of the duct to reduce boundary layer choking along the interconnected plurality of fins.

14. The method of claim 12, further comprising:

providing a thermal storage system, wherein the thermal storage system includes a phase change material; and conducting heat from the light emitting diode to the thermal storage system.

15. The method of claim 12, further comprising:

mounting the light emitting diode on a conductor for conducting heat away from the light emitting diode to the plurality of fins.

16. The heat removal assembly of claim 1, wherein the cross-section of the interconnected plurality of fins has a regular pattern.

17. The heat removal assembly of claim 1, wherein the gap spaces among the interconnected plurality of fins are not uniform.

18. The method of claim 12, the cross-section of the interconnected plurality of fins has a regular pattern.

19. The method of claim 12, wherein the gap spaces among the interconnected plurality of fins are not uniform.

20. A heat removal assembly for a lighting apparatus including one or more light emitting diodes (LEDs), the heat removal assembly comprising:

a conductor coupled to the one or more LEDs and configured to conduct heat away from the one or more LEDs;

a plurality of fins thermally coupled to the conductor, wherein the plurality of fins are arranged in a ring and a fin width is directed substantially in a radial direction, and wherein adjacent fins of the plurality of fins are separated by a radially-dependent gap width, and wherein each of the plurality of fins has a fin length in a first direction substantially perpendicular to the radial direction of the ring;

a duct comprising an inner surface and an outer surface, wherein the duct is configured to draw a stack-effect airflow past the plurality of fins through the gap widths, wherein a substantial portion of the stack-effect airflow flows substantially in the first direction along the fin length, and the gap width separating adjacent fins of the plurality of fins and the fin length of each of the plurality of fins are selected to reduce interference between neighboring boundary layers that form along the plurality of fins within the duct for a particular duct and fin configuration, and further wherein a cross-section of the duct decreases through at least a portion of the duct, wherein the fin length of each of the plurality of fins is configured to be shorter than a duct length of the duct, and wherein the gap width separating adjacent fins is configured to reduce interference between neighboring boundary layers that form along each of the fins.

* * * * *